United States Patent [19]

Nelson

[11] 3,960,271

[45] June 1, 1976

[54] CARRYING CASE FOR DARTS

[76] Inventor: Thomas N. Nelson, 443 Avenida Del Roble, San Jose, Calif. 95123

[22] Filed: Feb. 21, 1975

[21] Appl. No.: 551,596

[52] U.S. Cl. ..... 206/315 R; 220/331

[51] Int. Cl.[2] ..... B65D 85/00; A63D 65/02; B65D 43/16

[58] Field of Search ..... 206/315, 379; 220/331, 220/329, 375

[56] References Cited

UNITED STATES PATENTS 1,043,891 11/1912 Zange ..... 206/379

FOREIGN PATENTS OR APPLICATIONS 650,068 2/1951 United Kingdom ..... 206/315

*Primary Examiner*—William T. Dixson, Jr.
*Attorney, Agent, or Firm*—Boone, Schatzel & Hamrick

[57] ABSTRACT

A carrying case for darts including a molded unitary body member having a plurality of dart receiving chambers formed therein and a flip-top closure member which can be moved from a closed and locked position to an open position by laterally applied thumb pressure, and can be moved back into the closed and locked position by rotating it into a position above the chambers and then applying a downward pressure thereto.

6 Claims, 5 Drawing Figures

CARRYING CASE FOR DARTS

BACKGROUND OF THE INVENTION

1. Field of the Invention

The present invention relates generally to carrying cases for darts and the like, and more particularly, to an improved dart carrying case including a one piece molded body and a snap on, pivotable closure.

2. Description of the Prior Art

Numerous types of carrying cases have heretofore been provided for carrying a trio of feathered darts. Such cases have included a simple box device having spacers or webs for securing the darts in place, carved wooden holders having separate compartments for containing the respective darts, and molded plastic devices including shank and point receiving bores and feather receiving slots. Most such cases have, however, suffered from the disadvantage that they are either too expensive to manufacture because of their complexity, they are clumsy to carry because of their shape, or because they do not provide adequate protection for the component parts of the dart.

SUMMARY OF THE PRESENT INVENTION

It is therefore an objective of the present invention to provide a novel dart carrying case including a molded body which is compact and easy to carry and includes means for containing the darts within the case.

Another object of the present invention is to provide a dart carrying case which is ruggedly constructed and provides good protection for the point and feathers of the dart.

Briefly, the preferred embodiment of the present invention includes a molded unitary body which is of a width, thickness and length adequate to surround internal chambers which envelope and protect a trio of darts, but is still small enough to be easily carried. The lower portion of the body is tapered to reduce the mass and the external size of the device and the upper portion includes a pivotable flip-top closure which covers the containing openings to prevent the darts from being accidentally dislodged therefrom.

A principal advantage of the present invention is that it is comprised of only two readily molded components which interfit to provide a sturdy closable container which provides good protection for the components of darts to be carried therein.

Another advantage of the present invention is that because of its small streamlined configuration, it may be easily carried in the pocket of one's clothing.

These and other advantages of the present invention will no doubt become apparent to those of ordinary skill in the art after having read the following detailed description of the preferred embodiment illustrated in the several figures in the drawing.

IN THE DRAWING

DETAILED DESCRIPTION OF THE PREFERRED EMBODIMENT

Figure 1:
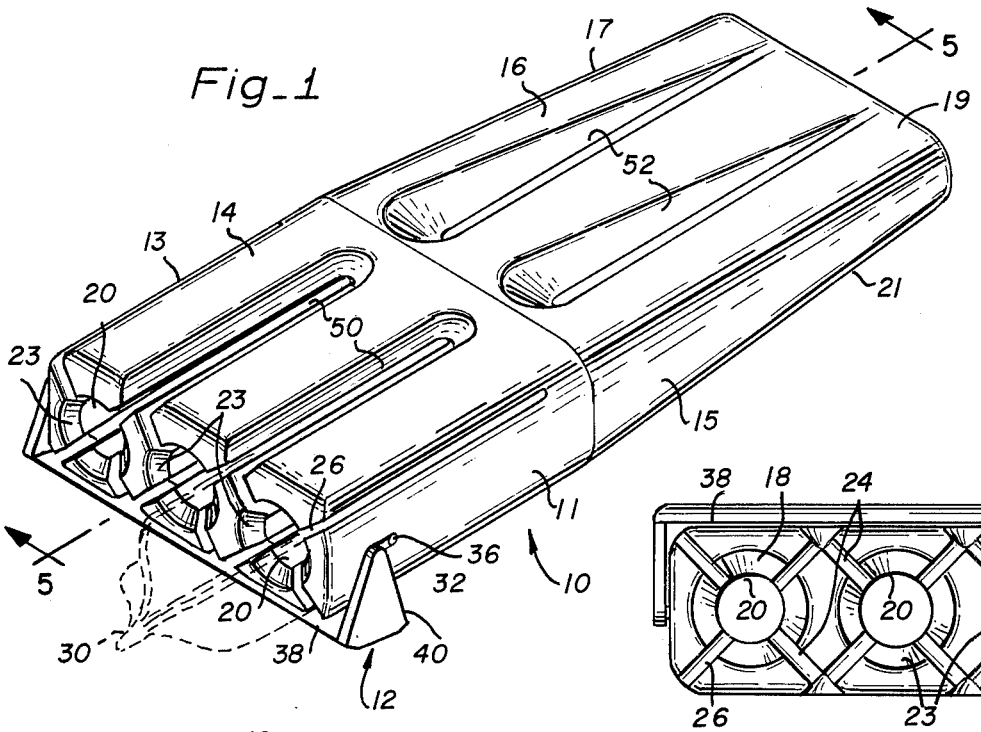
FIG. 1 is a perspective view illustrating a dart carrying case in accordance with the present invention.
Figure 2:
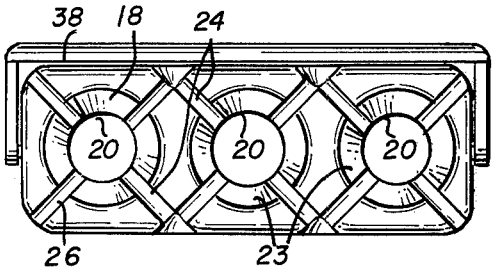
FIG. 2 is a plan view showing the top of the carrying case illustrated in FIG. 1.

Referring now to the drawing, a carrying case in accordance with the present invention is illustrated in perspective in FIG. 1 and includes a body 10 and a flip-top closure 12 pivotally engaged to the top portion of body 10. Body 10 is a unitary molded member including an upper portion 14 which is generally rectangular in cross-section as indicated in the top view shown in FIG. 2, and a bottom portion 16 having side surfaces 15 and 17 which are tapered approximately 3° relative to upper side surfaces 11 and 13, and front and rear surfaces 19 and 21 which are tapered approximately 5° relative to the corresponding upper portion surfaces. All of the exterior corners of the preferred embodiment are rounded as illustrated.

Figure 5:
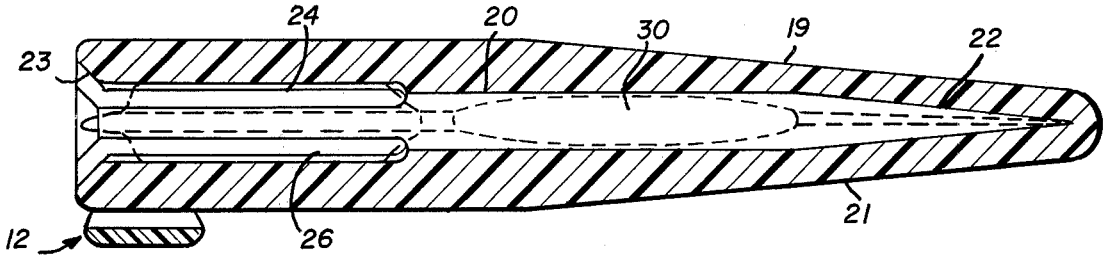
FIG. 5 is a cross-section taken along the line 5—5 of FIG. 1.

Extending through the top surface 18 and along the longitudinal length of body 10 are three ½-inch diameter bores 20 which, as illustrated in FIG. 5, are cylindrical over the major portion of their length, and then terminate in the lower portion of body 10 in a conical taper as indicated at 22. The circumferential edges of bores 20 are beveled as indicated at 23. In addition, three pairs of diagonal slots 24 and 26 extend through upper portion 14, respectively intersecting along the center lines of bores 20. As illustrated in FIG. 5, the bores 20 provide chambers for receiving the body and point members of darts shown by the dashed lines 30. Slots 24 and 26 receive the dart feathers.

Vertically-elongated slots 32 are formed along the center line of the side walls 11 and 13 near the top thereof and terminate at each end in dimpled recesses 34 and 36 which are slightly deeper than slot 32 and are spaced apart a predetermined distance. The positioning of slot 32 relative to top surface 18 is determined by the length of the side legs of closure 12 and the thickness of body portion 14 between the front and rear faces.

Figure 3:
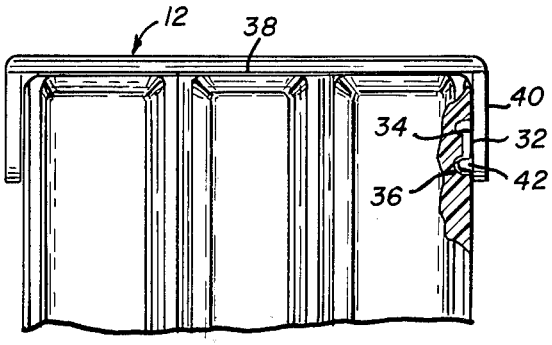
FIG. 3 is a partial front elevation showing the upper portion of the carrying case illustrated in FIG. 1.

Closure 12 is comprised of a unitary molded member including a generally flat cover portion 38 having a somewhat rounded upper surface, and a pair of triangular-shaped portions or side members 40 having rounded tabs 42 formed proximate the side member apices and extending inwardly toward each other as illustrated in FIG. 3. When tabs 42 are mated with recesses 36 the lower surface of cover portion 38 will be in close proximity to top surface 18, thereby providing a cover or closure for the dart receiving bores 20. Recess 34 is spaced above recess 36 a distance such that when tabs 42 are mated therewith the cover portion 38 may be rotated from a position parallel to the front face of body 10 to a position parallel the rear face thereof. It should be noted that alternatively, the pivot tabs could be formed on the sides of body 10 and the slots and recesses could be provided on the inside faces of closure side members 40.

Figure 4:
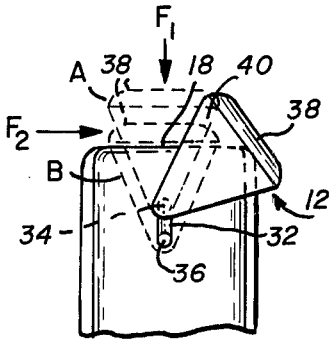
FIG. 4 is a partial side elevation showing the upper portion of the carrying case illustrated in FIG. 1.

With closure 12 in the position indicated by the solid lines in FIG. 4, the dart receiving chambers 20 will be open and ready to receive darts, and may then be closed by rotation into the position illustrated by the dashed lines A and the application of a vertical force $F_1$ which causes tabs 42 to cam out of the recesses 34 and move along slot 32 into the closed position indicated by the dashed lines B. Since in this position tabs 42 engage the recesses 36, and the proximity to surface 18 prevents rotation, closure 12 will be locked in this closed position.

In order to return closure 12 to the open position, a lateral force $F_2$ is applied to cover portion 38 causing the lower surface thereof to cam over the rounded edge of top 18. Since the radial distance from recess 36 to the edge of top 18 exceeds the distance to the center of top 18, the camming action over the rounded edge causes a lifting force to be applied to the side portions 40 which causes tabs 42 to be pulled from recesses 36 and to track upwardly along slot 32 and into engagement with recesses 34.

The above-described carrying case has the advantage that it is compact in external dimensions, includes feather receiving and protecting slots that will accommodate various-sized feathers. Since the slots are open to the faces of body 10, they may be easily cleaned and kept free from feather-damaging obstructions. Furthermore, the case includes a simple but highly effective lockable enclosure for preventing carried darts from being accidentally discharged from the carrying chambers. The external configuration illustrated includes troughed depressions 50 and 52 and could be further modified to reduce the body mass or to have a different decorative configuration.

The illustrated configuration has been found to be suitable because it readily lends itself to manufacture using injection molding techniques. The entire body configuration can be molded in a one-step mold with the only finish machining required being the provision of slots 32 and recesses 34 and 36 which could be provided by a simple milling jig. Alternatively, of course, these features could be provided in the mold but would require the removal of the forming protuberances before the body could be ejected from the mold. The flip-top closure 12 can also be easily molded. And since closure 12 is somewhat flexible, the side members 40 can be mated with body 10 by simply spreading the side members and positioning tabs 42 in alignment with slot 32.

Although a single preferred embodiment of the present invention has been described, it is to be appreciated that other alterations and modifications of the present invention will no doubt become apparent to those of ordinary skill in the art after having read the above disclosure. Accordingly, it is intended that the appended claims be interpreted to cover all such alterations and modifications as fall within the true spirit and scope of the invention.

What is claimed is:

1. A carrying case for darts, comprising:

an elongated unitary body including a plurality of parallel, spaced apart bores extending through the top surface of said body longitudinally thereinto to form dart receiving chambers, diagonal slots extending radially from said bores along a portion of the length thereof to form dart feathers receiving passages, and longitudinally extending elongated pivot slots formed in opposite side walls of said body proximate said top surface, said pivot slots each having an upper recess and a lower recess formed in spaced apart relationship along the length thereof; and a closure member including a rotatable into portion slightly longer than the width of said body and a pair of side portions extending from the ends thereof normal to said cover portion, said side portions each having a pivot tab extending inwardly toward the opposite side portion, said tabs being received by said pivot slots and moveable from engagement with one of said recesses along the slot and into engagement with the other recess, said closure member being rotatableinto a bore exposing position when said tabs are in engagement with said upper recesses and being locked in a bore closing position when said tabs are in engagement with said lower recesses.

2. A carrying case for darts as recited in claim 1 wherein said upper recesses are spaced from said top surface a predetermined distance and said lower recesses are spaced from the junctions of said top surface and the front and rear walls of said body said predetermined distance.

3. A carrying case for darts as recited in claim 1 wherein said diagonal slots extend from said bores to a face of said body.

4. A carrying case for darts as recited in claim 3 whrein adjacent slots radiating from adjacent bores intersect at a face of said body.

5. A carrying case for darts as recited in claim 1 wherein said body includes an upper portion which is generally rectangular in transverse cross-section and a lower portion which tapers from a first dimensional cross-section at the conjunction with said upper portion to a second smaller dimensional cross-section at the lower extremity of said body member.

6. A carrying case for darts as recited in claim 5 wherein adjacent slots radiating from adjacent bores intersect at a face of said body.

* * * * *

UNITED STATES PATENT OFFICE

CERTIFICATE OF CORRECTION

Patent No. 3,960,271 Dated June 1, 1976

Inventor(s) Thomas N. Nelson

It is certified that error appears in the above-identified patent and that said Letters Patent are hereby corrected as shown below:

Column 4, line 13, delete "rotatable into" and insert --cover--;

Column 4, line 22, "rotatableinto" should read --rotatable into--;

Column 4, line 37, "whrein" should read --wherein--.

Signed and Sealed this

Seventeenth Day of August 1976

[SEAL]

*Attest:*

RUTH C. MASON
*Attesting Officer*

C. MARSHALL DANN
*Commissioner of Patents and Trademarks*